US009803866B2

(12) United States Patent
Yoshino

(10) Patent No.: US 9,803,866 B2
(45) Date of Patent: Oct. 31, 2017

(54) FUEL INJECTOR

(71) Applicant: MITSUBISHI HEAVY INDUSTRIES, LTD., Tokyo (JP)

(72) Inventor: Ryo Yoshino, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 339 days.

(21) Appl. No.: 14/614,567

(22) Filed: Feb. 5, 2015

(65) Prior Publication Data

US 2016/0102863 A1 Apr. 14, 2016

(30) Foreign Application Priority Data

Oct. 14, 2014 (JP) ..... 2014-209813

(51) Int. Cl.

| | |
|---|---|
| ***B05B 7/06*** | (2006.01) |
| ***F23R 3/28*** | (2006.01) |
| ***B05B 7/04*** | (2006.01) |
| ***B05B 1/14*** | (2006.01) |
| ***F23D 14/02*** | (2006.01) |

(52) U.S. Cl.

CPC ..... *F23R 3/286* (2013.01); *B05B 1/14* (2013.01); *B05B 7/04* (2013.01); *B05B 7/06* (2013.01); *F23D 14/02* (2013.01); *F23R 3/283* (2013.01)

(58) Field of Classification Search

CPC ..... F23R 3/286; F23R 3/283; F23D 14/02; B05B 7/04; B05B 7/06; B05B 1/14

USPC .... 239/423, 424, 424.5, 428, 548, 549, 556, 239/557, 558; 60/39.463, 737

See application file for complete search history.

(56) References Cited

U.S. PATENT DOCUMENTS

| | | | | |
|---|---|---|---|---|
| 2,911,035 A * | 11/1959 | Nieman | F23D 14/82 | 239/423 |
| 4,100,733 A * | 7/1978 | Striebel | F23R 3/286 | 239/428 |
| 6,267,585 B1 * | 7/2001 | Suttrop | F23D 14/20 | 239/424.5 |
| 8,181,891 B2 * | 5/2012 | Ziminsky | F23D 14/48 | 60/737 |

FOREIGN PATENT DOCUMENTS

| | | |
|---|---|---|
| JP | 2011-69602 | 4/2011 |
| JP | 2012-149868 | 8/2012 |

* cited by examiner

*Primary Examiner* — Steven J Ganey
(74) *Attorney, Agent, or Firm* — Wenderoth, Lind & Ponack, L.L.P.

(57) ABSTRACT

A fuel injector (10) includes a fuel feed tube into which fuel gas (F) is introduced inward from a first end side in an axis direction in which an axis (O) extends, an upstream support plate connected to the fuel feed tube, a downstream support plate defining a plenum (P) inside along with the upstream support plate, and plurality of premixing tubes (16) into which air is introduced. When viewed in the axis direction, the plurality of premixing tubes (16) are disposed at positions excluding a position on the axis, that is, at positions of vertexes of virtual equilateral triangles (T1) when a cross-sectional region of the plenum (P) which is perpendicular to the axis is partitioned to closely dispose a plurality of virtual equilateral triangles (T1) around the axis.

5 Claims, 6 Drawing Sheets

FUEL INJECTOR

BACKGROUND OF THE INVENTION

Field of the Invention

The present invention relates to a fuel injector.

Priority is claimed on Japanese Patent Application No. 2014-209813, filed Oct. 14, 2014, the content of which is incorporated herein by reference.

Description of Related Art

When fuel gas is supplied to a combustor in, for instance, a gas turbine, the fuel gas and air are previously mixed and sprayed in a mist form by a fuel injector.

As this fuel injector, for example, a fuel injector in which a plenum is formed in a cylindrical shape and which has an internal baffle formed to increase in diameter toward a downstream side is disclosed in Patent Literature 1.

Such a fuel injector is formed by coupling an upstream-side tube support and a downstream-side tube support by an outer wall. The fuel injector is equipped with a fuel injector body, an internal space of which is used as a plenum. In the fuel injector, the internal baffle that widens in a radially outward direction so as to cross the internal plenum in a radial direction is disposed in the fuel injector body. In the fuel injector, a fuel feed tube is connected to an upstream side of the fuel injector body. The fuel injector is provided with a plurality of premixing tubes that pass through and are fixed to the upstream side tube support, the internal baffle, and the downstream side tube support. In the premixing tubes, fuel spray holes for introducing the fuel gas are disposed upstream from the internal baffle in the plenum.

In the fuel injector having this constitution, the fuel gas is introduced from the fuel feed tube into the plenum. The fuel gas introduced into the plenum advances along a surface of the downstream side of the internal baffle in a radially outward direction, and arrives at the vicinity of the outer wall. Afterwards, the fuel gas that has arrived at the vicinity of the outer wall flows into the fuel spray holes of the premixing tubes disposed in the radially outward direction while advancing along a surface of the upstream side of the internal baffle in a radially inward direction. The fuel gas flowing from the fuel spray holes into the premixing tubes is mixed with air, and is sprayed toward the downstream side of the premixing tubes.

CITATION LIST

Patent Literature

[Patent Literature 1]
Japanese Unexamined Patent Application, First Publication No. 2011-69602

SUMMARY OF THE INVENTION

Incidentally, in the fuel injector, when the fuel gas flows through the plenum in a radial direction, the fuel gas flows between the neighboring premixing tubes, and thereby sustains a pressure loss.

However, when there is a deviation in a distance between the neighboring premixing tubes in a circumferential direction and a radial direction, a difference in the pressure loss suffered from the premixing tubes occurs due to flow paths through which the fuel gas flows. Thus, there is a problem that a difference in a feed rate of the fuel gas flowing into the premixing tubes occurs, and it is difficult to uniformly mix and spray the fuel gas in the premixing tubes.

The present invention provides a fuel injector capable of easily spraying uniformly mixed fuel gas.

To solve the problem, the present invention proposes the following means.

According to a first aspect of the present invention, a fuel injector includes: a fuel feed tube which is shaped of a pipe whose center is an axis and into which fuel gas is introduced inward from a first end side in an axis direction in which the axis extends; an upstream support plate connected to the fuel feed tube at the second end side in the axis direction; a downstream support plate disposed at a second end side in the axis direction relative to the upstream support plate and configured to define a plenum inside along with the upstream support plate; and a plurality of premixing tubes which are provided to extend in the axis direction to be supported on the upstream and downstream support plates and into which air is introduced from the first end side in the axis direction. The plurality of premixing tubes are disposed at positions excluding a position on the axis, that is, at positions of vertexes of virtual equilateral triangles when viewed in the axis direction when a cross-sectional region of the plenum which is perpendicular to the axis is partitioned to closely dispose a plurality of virtual equilateral triangles around the axis, and have fuel introduction holes that are formed in portions located in the plenum and pass in and out of the premixing tubes. The fuel gas fed from the plenum into the premixing tubes via the fuel introduction holes is mixed with the air in the premixing tubes, and is sprayed from the premixing tubes at the second end side in the axis direction.

According to this configuration, the premixing tubes can be disposed such that a distance between the neighboring premixing tubes is the same at any position. When the fuel gas F flows from the centers of gravity of the virtual equilateral triangles toward outsides of the virtual equilateral triangles, a pressure loss which the fuel gas F suffers from the premixing tubes is made constant even when the fuel gas flows along a flow path in any of three directions in which the fuel gas is directed outward from the center of gravity. The plurality of virtual equilateral triangles is closely disposed on the cross-sectional region of the plenum. For this reason, when the fuel gas F flows from the axis in a radially outward direction, the pressure loss which the fuel gas suffers from the premixing tubes can be made uniform regardless of the flow path along which the fuel gas F flows. As a result, regardless of the flow paths in the plenum of the fuel gas fed from the fuel feed tube, the pressure loss occurring at the fuel gas can be made constant. Accordingly, a feed rate of the fuel gas fed from the fuel introduction holes into the premixing tubes can be made constant regardless of the positions of the disposed premixing tubes. As such, a mixture ratio of the air and the fuel gas mixed in the premixing tubes can be made constant.

In the fuel injector, the plurality of virtual equilateral triangles may be closed disposed in a state in which some of the vertexes thereof are disposed on the axis.

In the fuel injector, the plurality of virtual equilateral triangles may be closely disposed in a state in which the center of gravity of one thereof is disposed on the axis.

In the fuel injector, the plurality of premixing tubes may be disposed in the centers of gravity of the virtual equilateral triangles.

According to this configuration, even when the number of flow paths of the fuel gas is increased with an increase in the number of premixing tubes disposed in the plenum, the pressure loss which the fuel gas suffers from the premixing tubes can be made uniform.

The fuel injector may include pressure loss members that are disposed in the centers of gravity of the virtual equilateral triangles and act as resistors of a flow of the fuel gas in the plenum.

According to this configuration, regardless of the number of premixing tubes, the pressure loss which the fuel gas suffers can be made uniform regardless of the flow path along which the fuel gas flows. As a result, regardless of the flow paths in the plenum of the fuel gas fed from the fuel feed tube, the pressure loss occurring at the fuel gas can be made constant.

According to the present invention, regardless of the flow paths of the fuel gas in the plenum, the pressure loss of the fuel gas can be made constant, and the uniformly mixed fuel gas can be easily sprayed.

DETAILED DESCRIPTION OF THE INVENTION

First Embodiment

Hereinafter a first embodiment of the present invention will be described with reference to FIGS. 1 and 2.

In a fuel injector 10 according to the first embodiment of the present invention, a fuel gas F is introduced from a first end side in an axis O direction in which an axis O extends by a fuel feed tube 11. The fuel injector 10 mixes the introduced fuel gas F with air A in premixing tubes 16, and then sprays and discharges the mixture toward a second end side in the axis O direction.

In the present embodiment, the first end side in the axis O direction is referred to as an upstream side (the left side in FIG. 1) into which the fuel gas F is introduced, and the second end side in the axis O direction is referred to as a downstream side (the right side in FIG. 1) toward which the fuel gas F is sprayed. That is, in the fuel injector 10 of the present embodiment, the fuel gas F and the air A flow from the upstream side toward the downstream side.

Figure 1:
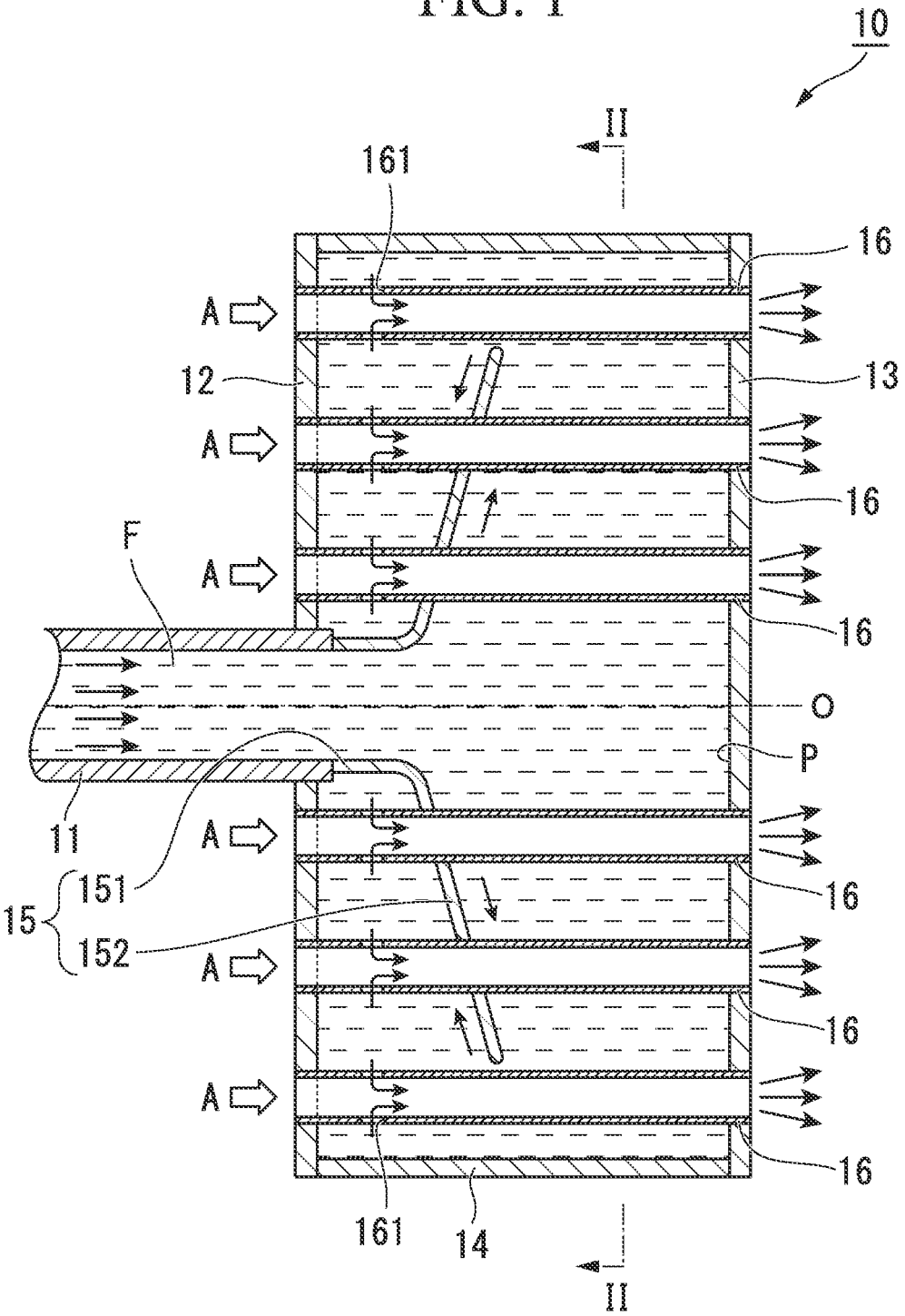
FIG. 1 is a longitudinal cross-sectional view for describing a fuel injector in a first embodiment of the present invention.
Figure 2:
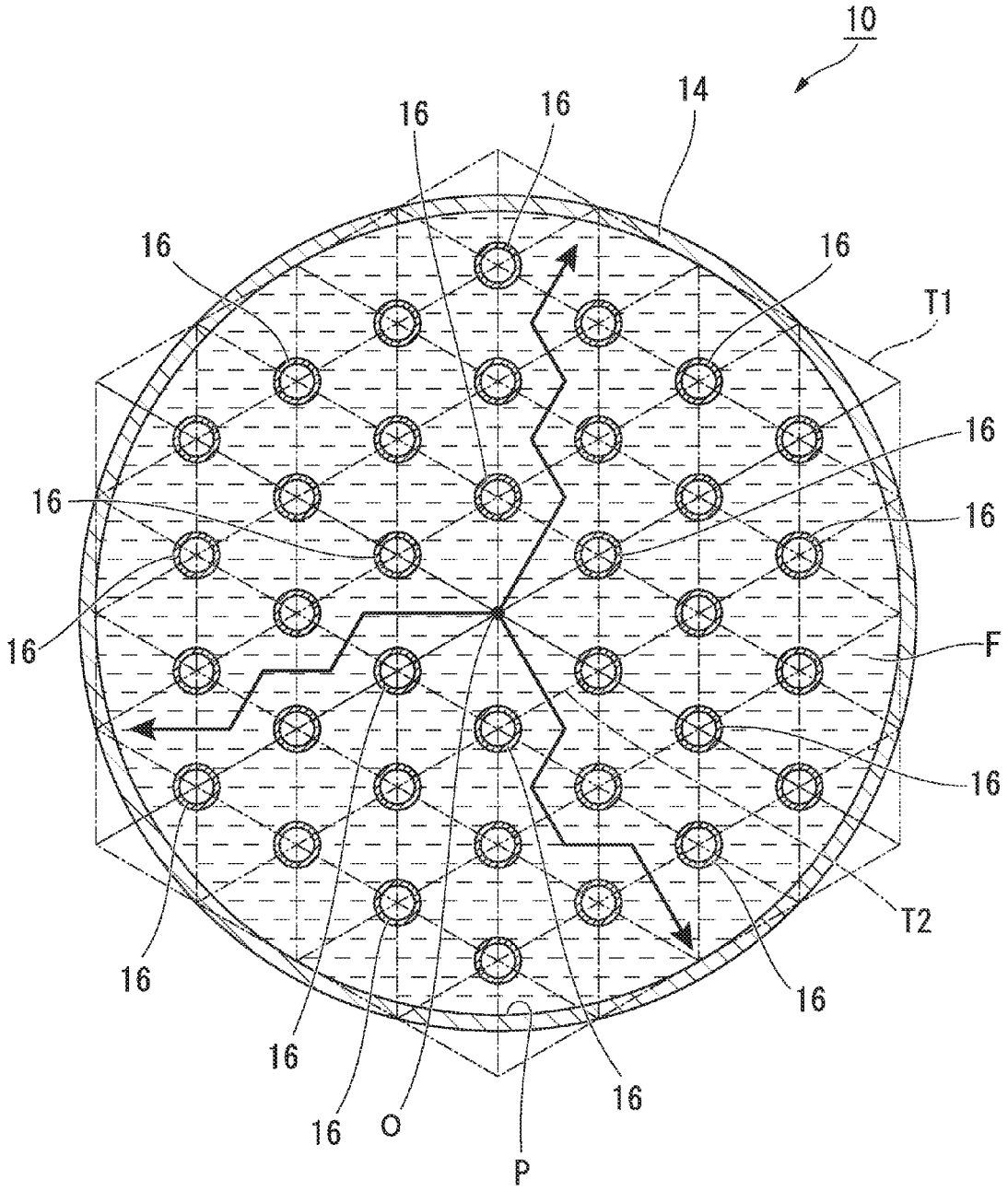
FIG. 2 is a transverse cross-sectional view taken along line II-II of FIG. 1 for describing the fuel injector according to the first embodiment of the present invention.

As illustrated in FIG. 1, the fuel injector 10 of the present embodiment includes an upstream support plate 12 connected to the fuel feed tube 11, a downstream support plate 13 disposed downstream from the upstream support plate 12, an outer wall 14 that connects the upstream support plate 12 and the downstream support plate 13 to define a plenum P inside, a plurality of premixing tubes 16 supported on the upstream support plate 12 and the downstream support plate 13, and an internal baffle 15 installed in the plenum P.

The fuel feed tube 11 flows the fuel gas F, which is fed from the upstream side in the axis O direction, to the plenum P. The fuel feed tube 11 extends in the shape of a pipe whose center is the axis O. The fuel feed tube 11 is connected to the upstream support plate 12 at the downstream side thereof.

The upstream support plate 12 of the present embodiment is shaped of a disk whose center is the axis O, and a circular through-hole is formed in the center thereof. This through-hole is formed with the same diameter as an outer diameter of the fuel feed tube 11. In a state in which the upstream support plate 12 is inserted into the through-hole such that an end of the fuel feed tube 11 protrudes downstream, the upstream support plate 12 is connected to the fuel feed tube 11. The upstream support plate 12 is formed with a plurality of through-holes for inserting and supporting the plurality of premixing tubes 16.

The downstream support plate 13 of the present embodiment has the same outer diameter as the upstream support plate 12, and is formed around the axis O in a disc shape. The downstream support plate 13 is connected to the upstream support plate 12 via the outer wall 14, thereby defining the plenum P, which is an inside space, along with the upstream support plate 12. The downstream support plate 13 is formed with a plurality of through-holes for inserting and supporting the plurality of premixing tubes 16 at positions corresponding to the through-holes formed in the upstream support plate 12.

The outer wall 14 connects outer circumferences of the upstream and downstream support plates 12 and 13. The outer wall 14 of the present embodiment has a cylindrical shape that is formed with an inner diameter having the same size as outer diameters of the upstream and downstream support plates 12 and 13. An end of the outer wall 14 on the upstream side in the axis O direction is connected to the upstream support plate 12. An end of the outer wall 14 on the downstream side in the axis O direction is connected to the downstream support plate 13. Accordingly, the plenum P acting as the defined space is provided on an inner side between the upstream and downstream support plates 12 and 13 connected by the outer wall 14.

The internal baffle 15 causes the fuel gas F fed from the fuel feed tube 11 to flow downstream in the plenum P in a radially outward direction, and causes the fuel gas F flowing in the vicinity of the outer wall 14 to reversely flow upstream so as to return in a radially inward direction. The internal baffle 15 of the present embodiment is connected to the fuel feed tube 11 in the plenum P. The internal baffle 15 includes a cylinder part 151 connected to the end of the downstream side of the fuel feed tube 11 in the axis O direction, and a diameter expansion part 152 that is connected to the downstream side of the cylinder part 151 in the axis O direction and is gradually increased in diameter toward the downstream side.

The upstream side of the cylinder part 151 in the axis O direction is connected to the end of the downstream side of the fuel feed tube 11. The cylinder part 151 has a cylindrical shape that is formed with the same outer diameter as the fuel feed tube 11.

The diameter expansion part 152 is formed such that the portion thereof that is connected to the cylinder part 151 is formed with the same outer diameter as the cylinder part 151, and that its outer diameter is gradually increased toward the downstream side. The diameter expansion part 152 is formed such that an outer diameter of its end at the downstream side is smaller than an inner circumferential surface of the outer wall 14.

The premixing tubes 16 are cylindrical tubes extending in the axis O direction. In the premixing tubes 16, the air A is introduced from the upstream side in the axis O direction, and a gas formed by mixing the air A and the fuel gas F is discharged from the downstream side. Ends of the premixing tubes 16 at the upstream side in the axis O direction are supported by the upstream support plate 12. Ends of the premixing tubes 16 at the downstream side in the axis O direction are supported by the downstream support plate 13.

Specifically, the premixing tubes 16 of the present embodiment are fixed such that their ends at the upstream side in the axis O direction are flush with each other without protruding upstream from the upstream support plate 12 in the axis O direction. The premixing tubes 16 are fixed such that their ends at the downstream side in the axis O direction are flush with each other without protruding downstream from the downstream support plate 13 in the axis O direction. In the premixing tubes 16, fuel introduction holes 161 passing in and out of the premixing tubes 16 in a radial direction perpendicular to the axis O direction are formed at positions located in the plenum P.

A plurality of premixing tubes 16 are provided for the upstream support plate 12 and the downstream support plate 13. The plurality of premixing tubes 16 is formed to have the same cross-sectional shape and length as each other. As illustrated in FIG. 2, when a cross-sectional region of the plenum P which is perpendicular to the axis O is partitioned to closely dispose a plurality of virtual equilateral triangles T1 around the axis O, the plurality of premixing tubes 16 is disposed at positions excluding a position on the axis O, that is, at positions of the vertexes of the virtual equilateral triangles T1 when viewed in the axis O direction.

The virtual equilateral triangles T1 of the present embodiment are a plurality of equilateral triangles disposed to radially spread around the axis O on a virtual plane that is the cross-sectional region of the plenum P which is perpendicular to the axis O. A length of one side of the virtual equilateral triangles T1 is determined from a distance at which the premixing tubes 16 are disposed and which is separated from the axis O or a distance between the neighboring premixing tubes 16. In the present embodiment, the congruent virtual equilateral triangles T1 are closely disposed on the cross-sectional region of the plenum P. The plurality of virtual equilateral triangles T1 is closely disposed in a state in which some of the vertexes thereof are disposed on the axis O with respect to the cross-sectional region of the plenum P.

That is, in the present embodiment, among the plurality of virtual equilateral triangles T1, the virtual equilateral triangles T1 disposed in the center of the cross-sectional region of the plenum P are disposed at positions at which one of the vertexes thereof overlaps with the axis O.

As the plurality of premixing tubes 16 are disposed at the vertexes of the virtual equilateral triangles T1, they are disposed at the positions other than the axis O such that they are radially formed around the axis O in a radially outward direction and gradually increase in number.

The fuel introduction holes 161 are through-holes through which the fuel gas F is caused to flow into the premixing tubes 16 in the plenum P. The fuel introduction holes 161 have circular cross-sectional shapes, and pass through the premixing tubes 16 in a radial direction. The fuel introduction holes 161 are formed at the upstream side in the axis O direction relative to a position at which the diameter expansion part 152 of the internal baffle 15 in the plenum P is disposed. Regardless of the positions at which the plurality of premixing tubes 16 are disposed, the fuel introduction holes 161 are disposed at all the premixing tubes 16 at the same position in the axis O direction with respect to the plenum P.

Next, an operation of the fuel injector 10 of the first embodiment will be described.

In the first embodiment, the fuel gas F is introduced into the plenum P from the upstream side in the axis O direction via the fuel feed tube 11. The introduced fuel gas F flows radially outward along a surface facing the downstream side of the diameter expansion part 152 of the internal baffle 15 between the diameter expansion part 152 and the downstream support plate 13. That is, when viewed in the axis O direction, the fuel gas F flows radially outward so as to pass through between the neighboring premixing tubes 16 on the cross-sectional region of the plenum P which is perpendicular to the axis O while radially spreading from the axis O.

When the fuel gas F flows to the vicinity of the inner circumferential surface of the outer wall 14 in a radially outward direction, the fuel gas F changes its course so as to go around the diameter expansion part 152, and flows from the downstream side to the upstream side in the axis O direction. Afterwards, the fuel gas F flows radially inward along the surface of the diameter expansion part 152 which faces upstream between the upstream support plate 12 and the diameter expansion part 152. The fuel gas F flowing radially inward is sequentially introduced from the premixing tubes 16 disposed at the outermost side in the radial direction via the fuel introduction holes 161 into the premixing tubes 16. In the premixing tubes 16 into which the fuel gas F flows, the air A introduced from the upstream side in the axis O direction and the fuel gas F are mixed and sprayed and discharged from the downstream side in the axis O direction.

According to the fuel injector 10 described above, in the state in which the vertexes of the virtual equilateral triangles T1 are disposed on the axis O, the premixing tubes 16 are disposed at the vertexes of the virtual equilateral triangles T1 closely disposed on the cross-sectional region of the plenum P around the axis O. That is, the premixing tubes 16 can be disposed such that a distance between the neighboring premixing tubes 16 is the same at any position. Thus, when the fuel gas F flows from the centers of gravity of the virtual equilateral triangles T1 toward the outsides of the virtual equilateral triangles T1, a pressure loss which the fuel gas F suffers from the premixing tubes 16 is constant even when the fuel gas F flows to a flow path in any of three directions in which it is directed outward from the center of gravity. That is, the plurality of virtual equilateral triangles T1 is closely disposed on the cross-sectional region of the plenum P such that the vertexes of the virtual equilateral triangles T1 overlap with the axis O. For this reason, when the fuel gas F flows from the axis O to the vicinity of the inner circumferential surface of the outer wall 14 in the radially outward direction, the pressure loss which the fuel gas F suffers from the premixing tubes 16 can be made uniform regardless of the flow path along which the fuel gas F flows. As a result, regardless of the flow paths in the plenum P of the fuel gas F fed from the fuel feed tube 11, the pressure loss occurring at the fuel gas F can be made constant. Accordingly, a feed rate of the fuel gas F fed from the fuel introduction holes 161 into the premixing tubes 16 can be made constant regardless of the positions of the disposed premixing tubes 16. As such, the air A and the fuel gas F can be uniformly mixed by the premixing tubes 16. Thus, the uniformly mixed fuel gas F can be easily sprayed.

Since the uniformly mixed fuel gas F can be easily sprayed, combustion temperatures at exhaust nozzles of the plurality of premixing tubes 16 at the downstream side in the axis O direction can each be set to a similar temperature level. Accordingly, the premixing tubes 16 having similar combustion temperature levels are disposed at regular intervals by the virtual equilateral triangles T1, and thereby the combustion temperature can be made uniform in the entire combustor.

Second Embodiment

Figure 3:
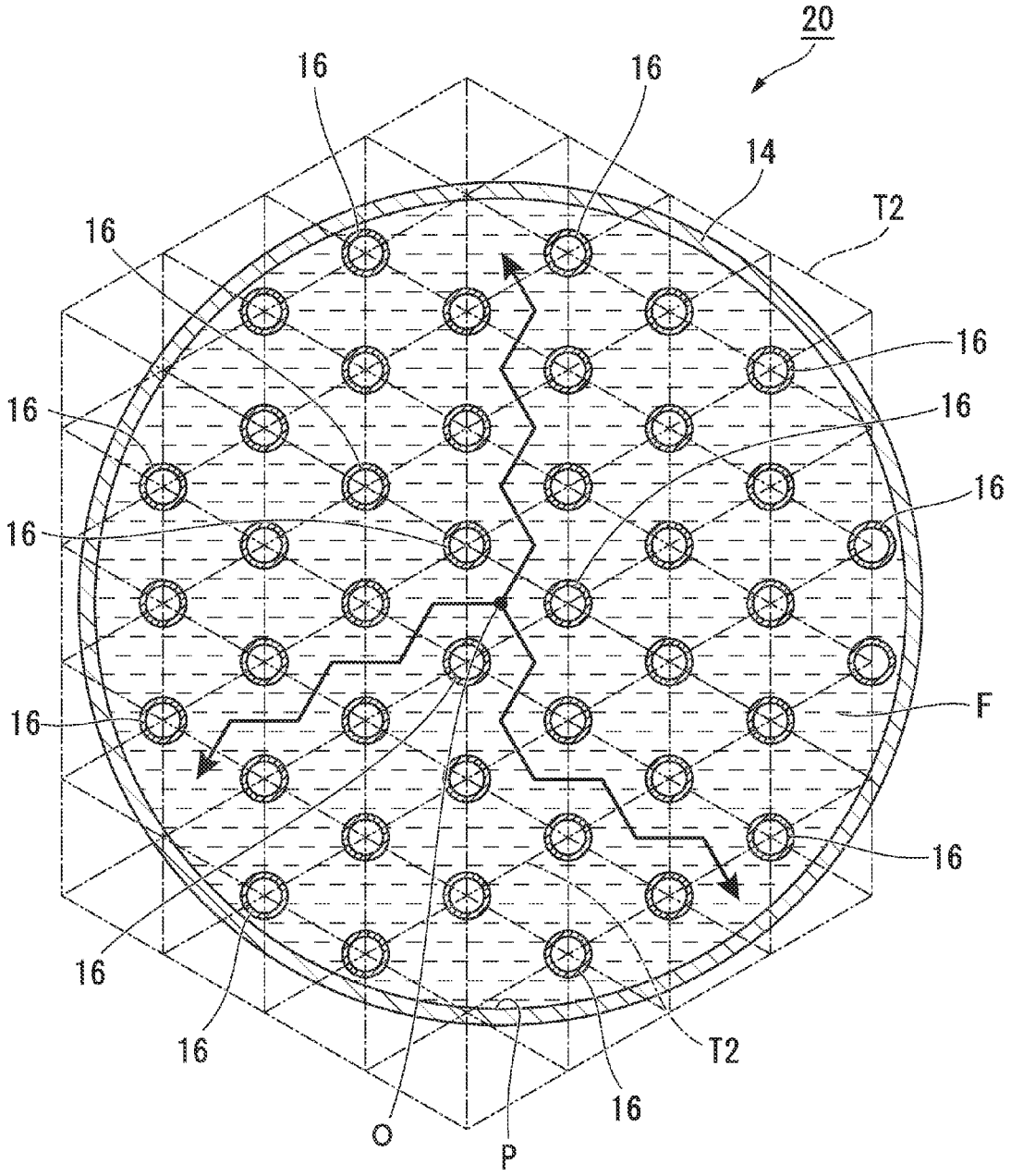
FIG. 3 is a view describing a fuel injector according to a second embodiment of the present invention that is equivalent to the transverse cross-sectional view taken along line II-II of FIG. 1.

Next, a fuel injector 20 of a second embodiment will be described with reference to FIG. 3.

In the second embodiment, the same components as in the first embodiment are given the same symbols, and detailed description thereof will be omitted. In the fuel injector 20 of the second embodiment, positions of a plurality of virtual equilateral triangles in a cross section of a plenum P are different from those of the first embodiment.

In a cross-sectional region of the plenum P which is perpendicular to the axis O in the second embodiment, the plurality of virtual equilateral triangles T2 are closely disposed in a state in which the center of gravity of one thereof is disposed on the axis O. That is, in the present embodiment, as illustrated in FIG. 3, among the plurality of virtual equilateral triangles T2, the virtual equilateral triangle T2 disposed in the center of the cross-sectional region of the plenum P is disposed at a position at which the center of gravity thereof overlaps with the axis O. A length of one side of the virtual equilateral triangles T2 is formed to be the same as in the first embodiment.

According to the fuel injector 20 described above, in the state in which the center of gravity of the virtual equilateral triangle T2 is disposed on the axis O, the premixing tubes 16 are disposed at vertexes of the plurality of virtual equilateral triangles T2 closely disposed on the cross-sectional region of the plenum P around the axis O. The plurality of virtual equilateral triangles T2 is closely disposed on the cross-sectional region of the plenum P such that the center of gravity of one of the virtual equilateral triangles T2 overlaps with the axis O. For this reason, similar to the first embodiment, when the fuel gas F flows from the axis O to the vicinity of the inner circumferential surface of the outer wall 14 in a radially outward direction, a pressure loss which the fuel gas F suffers from the premixing tubes 16 can be made uniform regardless of the fuel path along which the fuel gas F flows. As a result, regardless of the flow paths in the plenum P of the fuel gas F fed from the fuel feed tube 11, the pressure loss occurring in the fuel gas F can be made constant. Accordingly, a feed rate of the fuel gas F fed from the fuel introduction holes 161 into the premixing tubes 16 can be made constant regardless of the positions of the disposed premixing tubes 16. As such, the air A and the fuel gas F can be uniformly mixed by the premixing tubes 16. Thus, the uniformly mixed fuel gas F can be easily sprayed. As a result, like the first embodiment, combustion temperatures at exhaust nozzles of the plurality of premixing tubes 16 at the downstream side in the axis O direction can each be set to a similar temperature level, and the combustion temperature can be made uniform in the entire combustor.

Third Embodiment

Next, a fuel injector 30 of a third embodiment will be described with reference to FIG. 4.

In the third embodiment, the same components as in the first and second embodiments are given the same symbols, and detailed description thereof will be omitted. The fuel injector 30 of the third embodiment is different from that of the first embodiment in that premixing tubes 16 are also disposed in the centers of gravity of virtual equilateral triangles.

Figure 4:
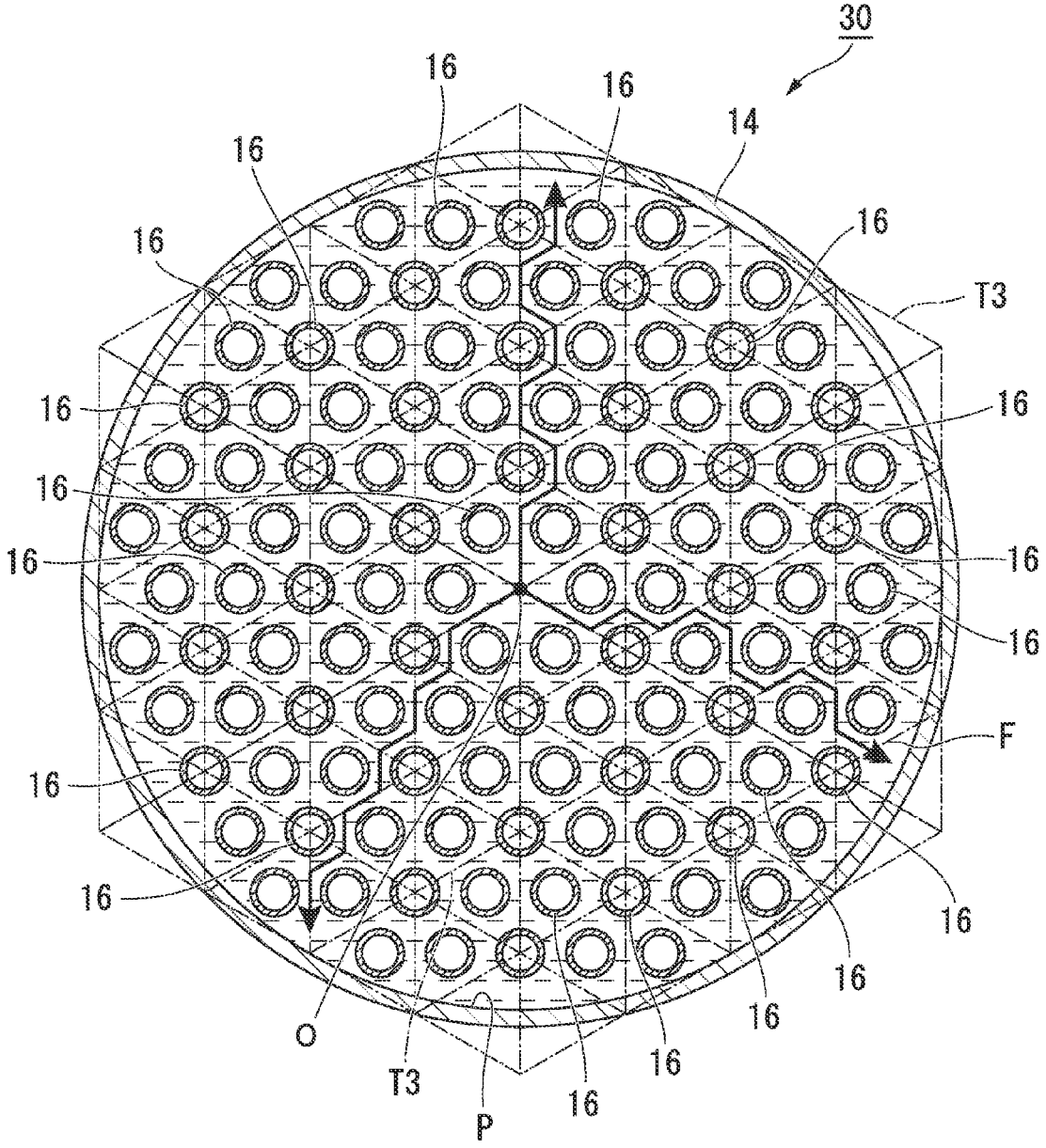
FIG. 4 is a view describing a fuel injector according to a third embodiment of the present invention that is equivalent to the transverse cross-sectional view taken along line II-II of FIG. 1.

In a cross-sectional region of a plenum P which is perpendicular to an axis O in the third embodiment, as illustrated in FIG. 4, the plurality of premixing tubes 16 is disposed at vertexes excluding the axis O as well as the centers of gravity of the virtual equilateral triangles T3. Like the first embodiment, the virtual equilateral triangles T3 of the third embodiment are configured in such a manner that, among the plurality of virtual equilateral triangles T3, the virtual equilateral triangles T3 disposed in the center of the cross-sectional region of the plenum P are disposed at positions at which one of the vertexes thereof overlaps with the axis O. Accordingly, in the third embodiment, the premixing tubes 16 are disposed in the centers of gravity of the plurality of virtual equilateral triangles T3 disposed in the center of the cross-sectional region of the plenum P other than the center of gravity overlapping with the axis O among the centers of gravity of the plurality of virtual equilateral triangles T3.

According to the fuel injector 30 described above, a distance between the premixing tubes 16 disposed at the three vertexes and the center of gravity of each virtual equilateral triangle T3 can be equalized. The distance between the premixing tubes 16 can also be equalized at the neighboring virtual equilateral triangles T3. For this reason, the premixing tubes 16 can be disposed such that the distance between the neighboring premixing tubes 16 is made smaller than the distance between the neighboring premixing tubes 16 in the first embodiment and is the same at any position. Accordingly, even when the number of flow paths of the fuel gas F is increased with an increase in the number of premixing tubes 16 disposed in the plenum P, a pressure loss which the fuel gas F suffers from the premixing tubes 16 can be made uniform. As a result, like the first and second embodiments, combustion temperatures at exhaust nozzles of the plurality of premixing tubes 16 at the downstream side in the axis O direction can each be set to a similar temperature level, and the combustion temperature can be made uniform in the entire combustor.

Fourth Embodiment

Figure 5:
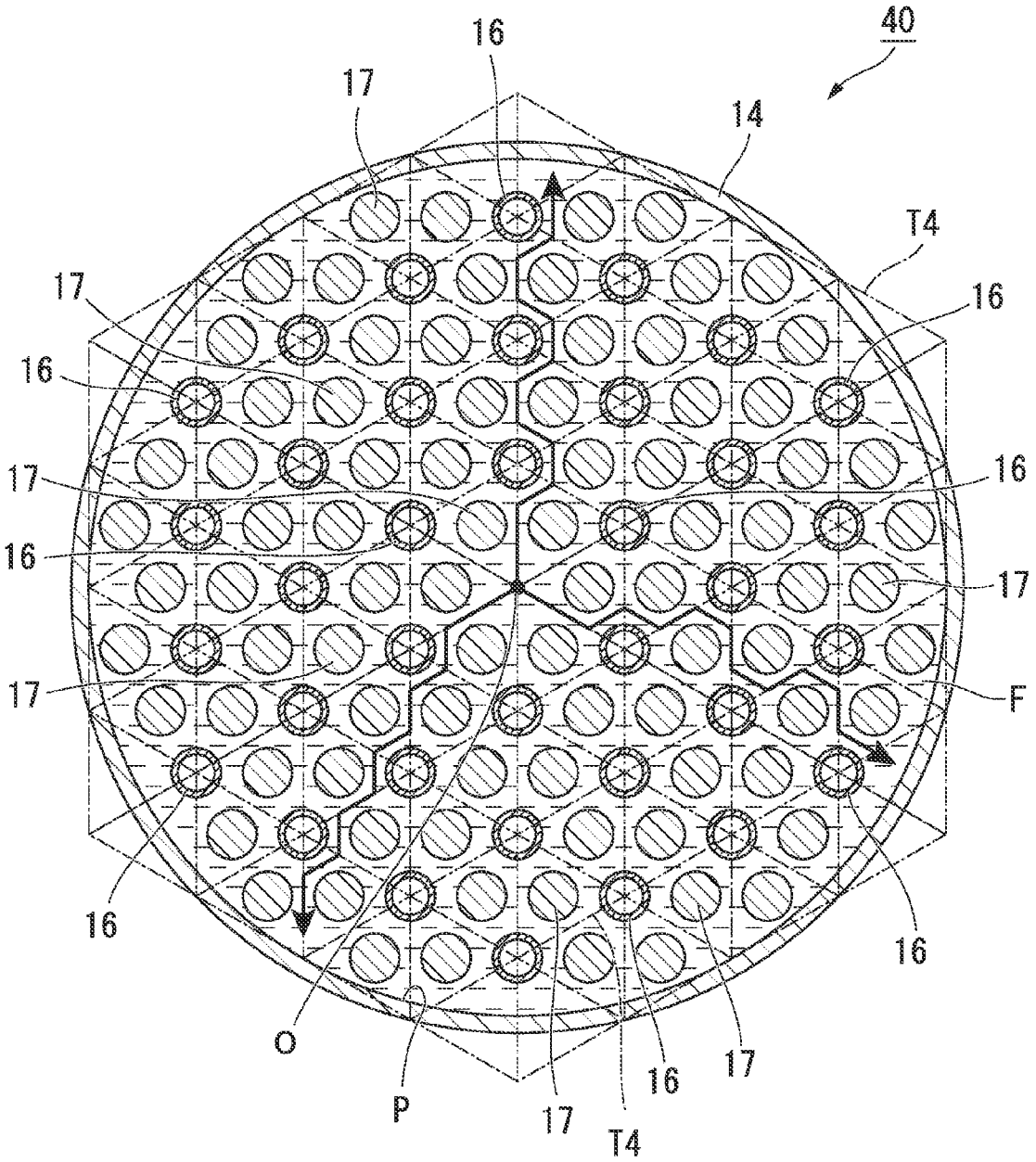
FIG. 5 is a view describing a fuel injector according to a fourth embodiment of the present invention that is equivalent to the transverse cross-sectional view taken along line II-II of FIG. 1.

Next, a fuel injector 40 of a fourth embodiment will be described with reference to FIG. 5.

In the fourth embodiment, the same components as in the first to third embodiments are given the same symbols, and detailed description thereof will be omitted. The fuel injector 40 of the fourth embodiment is different from that of the first to third embodiments in that it is equipped with pressure loss members 17.

The fuel injector 40 of the fourth embodiment includes the pressure loss members 17 that are disposed in the centers of gravity of the virtual equilateral triangles T4 to serve as resistors of a flow of fuel gas F in a plenum P, and cause a pressure loss for the fuel gas F. Like the first embodiment, the virtual equilateral triangles T4 of the fourth embodiment are configured in such a manner that, among the plurality of virtual equilateral triangles T4, the virtual equilateral triangles T4 disposed in a center of a cross-sectional region of the plenum P are disposed at positions at which one of vertexes thereof overlaps with an axis O.

The pressure loss members 17 of the present embodiment are solid rod-shaped members, each of which is formed with the same outer diameter as each premixing tube 16. That is, the pressure loss members 17 are intended to cause the pressure loss, and thus no fuel gas F is fed thereinto. The pressure loss members 17 are disposed in the centers of gravity of the respective virtual equilateral triangles T4.

According to the fuel injector 40 described above, due to use of the pressure loss members 17, it is possible to adjust the pressure loss which the fuel gas F suffers without increasing the number of premixing tubes 16. Further, regardless of the number of premixing tubes 16, the pressure loss which the fuel gas F suffers can be made uniform regardless of the flow path along which the fuel gas F flows. As a result, regardless of the flow paths in the plenum P of the fuel gas F fed from the fuel feed tube 11, the pressure loss occurring at the fuel gas F can be made constant. Thus, the air A and the fuel gas F can be uniformly mixed by the premixing tubes 16. Thus, the uniformly mixed fuel gas F can be easily sprayed. As a result, like the first to third embodiments, combustion temperatures in exhaust nozzles of the plurality of premixing tubes 16 at the downstream side in the axis O direction can each be set to a similar temperature level, and the combustion temperature can be made uniform in the entire combustor.

The pressure loss members 17 are used instead of the premixing tubes 16, and can reduce a flow rate of the fuel gas F flowing in the plenum P.

Modified Example of Fourth Embodiment

Figure 6:
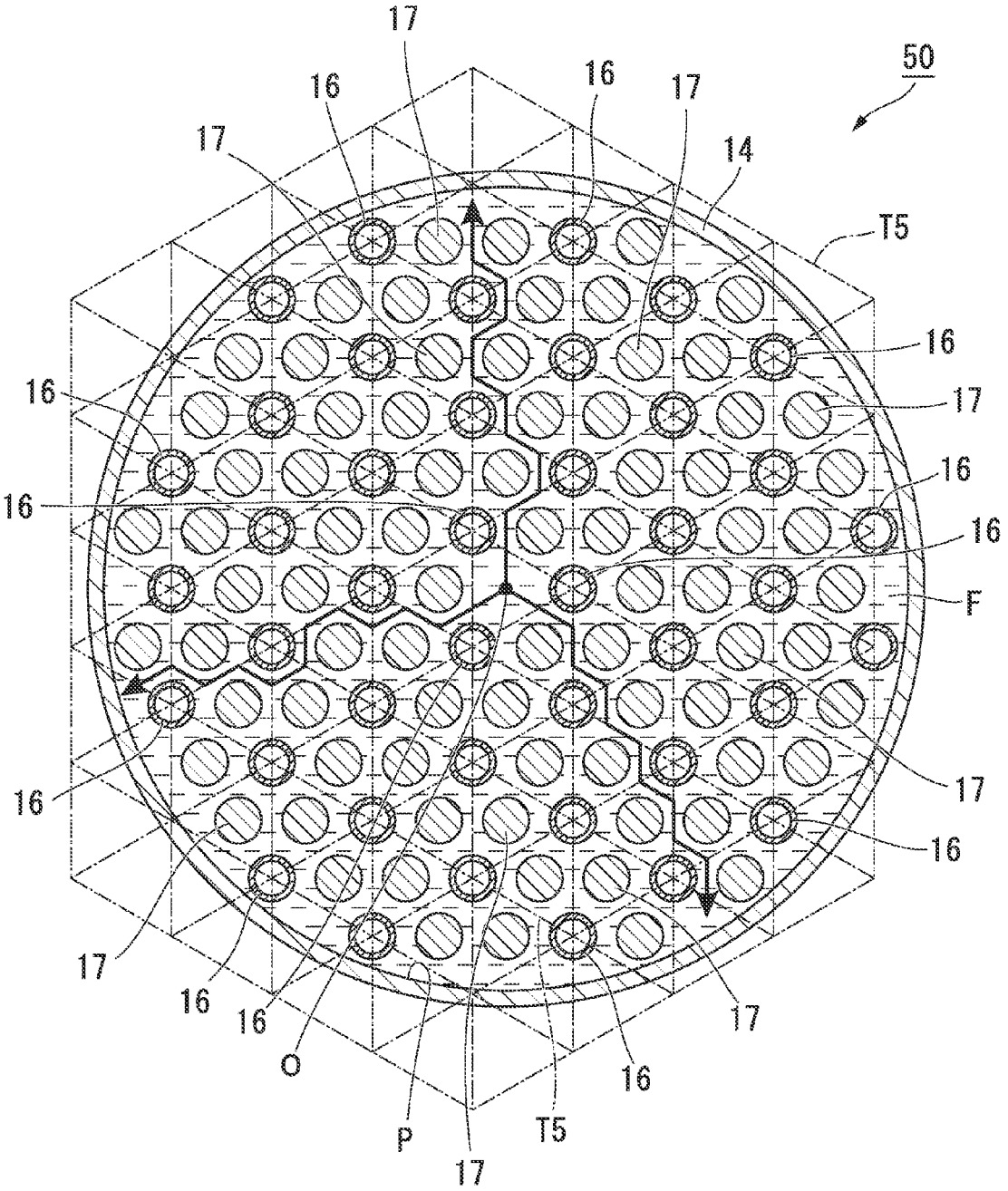
FIG. 6 is a view describing a fuel injector according to a modified example of the present invention that is equivalent to the transverse cross-sectional view taken along line II-II of FIG. 1.

In the aforementioned embodiment, virtual equilateral triangles T5 are configured like the first and third embodiments in such a manner that, among the plurality of virtual equilateral triangles T5, the virtual equilateral triangles T5 disposed in the center of a cross-sectional region of a plenum P are disposed at positions at which one of vertexes thereof overlaps with an axis O, but the present invention is not limited thereto. For example, as a modified example, as illustrated in FIG. 6, the center of gravity of the virtual equilateral triangle T5 disposed in the center of the cross-sectional region of the plenum P among the plurality of virtual equilateral triangles T5 may be disposed on the axis O. In this case, pressure loss members 17 are disposed in the centers of gravity of the virtual equilateral triangles T5 other than the virtual equilateral triangle T5 which is disposed in the center of the cross-sectional region of the plenum P and the center of gravity of which overlaps with the axis O. Even with this configuration, like the fourth embodiment, the pressure loss members 17 can be effectively used.

Although embodiments of the present invention have been described with reference to the drawings, the respective configurations of the embodiments and combinations thereof are given as examples. Additions, omissions, substitutions, and other modified examples can be made without departing from the scope of the present invention. Accordingly, the invention is not to be considered as being limited by the foregoing description, and is only limited by the scope of the appended claims.

The virtual equilateral triangles T1, T2, T3, T4, or T5 are not limited to being congruent as in the above embodiments. For example, virtual equilateral triangles having sides longer than those of the virtual equilateral triangles T1, T2, T3, T4, or T5 of the above embodiments may be disposed near the center of the cross-sectional region of the plenum P, and the virtual equilateral triangles T5 having the same shape as in the above embodiments may be disposed therearound, and thereby may be closely disposed with respect to the cross-sectional region of the plenum P.

The plenum P defined by the upstream support plate 12 and the downstream support plate 13 is not limited to the space as in the above embodiments, and may be formed in an arbitrary shape. For example, without using the internal baffle 15, the plenum P may be defined in such a way that the diameter of the upstream support plate 12 decreases such that the upstream support plate 12 gradually becomes the same size as the outer diameter of the downstream support plate 13 toward the downstream side in the axis O direction.

According to the cylinder of the aforementioned fuel injector, regardless of the flow paths of the fuel gas in the plenum, the pressure loss of the fuel gas can be made constant, and the uniformly mixed fuel gas can be easily sprayed.

REFERENCE SIGNS LIST

O: axis
F: fuel gas
A: air
10, 20, 30, 40, 50: fuel injector
11: fuel feed tube
12: upstream support plate
13: downstream support plate
14: outer wall
P: plenum
15: internal baffle
151: cylinder part
152: diameter expansion part
16: premixing tube
161: fuel introduction hole
T1, T2, T3, T4, T5: virtual equilateral triangle
17: pressure loss member

What is claimed is:

1. A fuel injector comprising:

a fuel feed tube which is shaped of a pipe whose center is an axis and into which fuel gas is introduced inward from a first end side in an axis direction in which the axis extends;

an upstream support plate connected to the fuel feed tube at a downstream side of the fuel feed tube in the axis direction;

a downstream support plate disposed at a second end side in the axis direction relative to the upstream support plate and configured to define a plenum inside along with the upstream support plate; and a plurality of premixing tubes which are provided to extend in the axis direction to be supported on the upstream and downstream support plates and into which air is introduced from the first end side in the axis direction, wherein, when viewed in the axis direction when a cross-sectional region of the plenum which is perpendicular to the axis is partitioned to closely dispose a plurality of virtual equilateral triangles of the same size around the axis, the plurality of premixing tubes are disposed at positions of all vertexes of the plurality of virtual equilateral triangles disposed within the plenum, and excluding a position on the axis, the plurality of premixing tubes is provided with fuel introduction holes that are formed in portions located in the plenum and pass in and out of the premixing tubes, the fuel gas fed from the plenum into the premixing tubes via the fuel introduction holes is mixed with the air in the premixing tubes, and is sprayed from the premixing tubes at the second end side in the axis direction, and a length of one side of each of the virtual equilateral triangles is larger than a diameter of each of the premixing tubes.

2. The fuel injector according to claim 1, wherein the plurality of virtual equilateral triangles are closely disposed in a state in which some of the vertexes thereof are disposed on the axis.

3. The fuel injector according to claim 1, wherein the plurality of virtual equilateral triangles are closely disposed in a state in which the center of gravity of one thereof is disposed on the axis.

4. The fuel injector according to claim 1, wherein the plurality of premixing tubes are disposed in the centers of gravity of the virtual equilateral triangles.

5. The fuel injector according to claim 1, wherein the fuel injector includes pressure loss members that are disposed in the centers of gravity of the virtual equilateral triangles and act as resistors of a flow of the fuel gas in the plenum.

* * * * *